United States Patent [19]

Kassel et al.

[11] 4,343,883

[45] Aug. 10, 1982

[54] METHOD FOR PRODUCING AN ELECTROPHOTOGRAPHIC RECORDING MATERIAL HAVING DUAL LAYER OF AMORPHOUS AND CRYSTALLIZED SE

[75] Inventors: Karl-Heinz Kassel; Manfred Lutz, both of Warstein; Josef Stuke, Marburg; Hubert Walsdorfer, Warstein, all of Fed. Rep. of Germany

[73] Assignee: Licentia Patent-Verwaltungs-G.m.b.H., Frankfurt am Main, Fed. Rep. of Germany

[21] Appl. No.: 221,445

[22] Filed: Dec. 30, 1980

[30] Foreign Application Priority Data

Jan. 5, 1980 [DE] Fed. Rep. of Germany ..... 3000305

[51] Int. Cl.[3] ..... B05D 5/12

[52] U.S. Cl. ..... 430/128; 430/84; 430/85; 427/76; 427/255.7

[58] Field of Search ..... 430/128, 84, 85; 427/76, 248 J

[56] References Cited

U.S. PATENT DOCUMENTS 4,011,079 3/1977 Berle et al. ..... 430/128

FOREIGN PATENT DOCUMENTS 1522622 10/1969 Fed. Rep. of Germany ..... 430/128
2808757 4/1980 Fed. Rep. of Germany .

*Primary Examiner*—John D. Welsh
*Attorney, Agent, or Firm*—Spencer & Kaye

[57] ABSTRACT

In a method for producing an electrophotographic recording material composed of a dual layer of amorphous and crystallized selenium applied to an electrically conductive substrate, tellurium is vapor-deposited in a vacuum onto the surface of the conductive substrate to a layer thickness of about 0.5 to about 5 nanometers to form a tellurium layer, and selenium is vapor-deposited onto the tellurium layer to a layer thickness of about 20 to about 100 microns to form the dual layer of amorphous and crystallized selenium.

13 Claims, 2 Drawing Figures

METHOD FOR PRODUCING AN ELECTROPHOTOGRAPHIC RECORDING MATERIAL HAVING DUAL LAYER OF AMORPHOUS AND CRYSTALLIZED SE

BACKGROUND OF THE INVENTION

The present invention relates to a method for producing an electrophotographic recording material composed of a double layer of amorphous and crystallized selenium which is applied to an electrically conductive substrate.

Electrophotographic processes and apparatus for this purpose have found wide acceptance in the duplicating art. They are based on the property of a photoconductive material to change its electrical resistance when exposed to an activating radiation.

After electrically charging and illuminating a photoconductive layer with an activating radiation, a latent electrical charge image corresponding to an optical image can be produced on the photoconductive layer. At the illuminated points, the conductivity of the photoconductive layer is increased to such an extent that the electrical charge can flow off, at least in part, through the conductive substrate; or in any case more than at the unilluminated points. At the unilluminated points, the electrical charge remains essentially unchanged. The image can be made visible by means of an image powder, a so-called toner, and the resulting toner image can then be transferred, if desired, to paper or to some other medium.

Electrophotographically effective substances employed are organic as well as inorganic. Among these substances, selenium, selenium alloys and selenium compounds have gained particular significance. Especially in the amorphous state, these substances play an important part and have found many fields of use.

The change in electrical conductivity of a photoconductive layer depends on the intensity of the wavelength of the radiation employed. In the range of visible light, which is preferred for practical use in electrophotography, amorphous selenium exhibits high sensitivity on the blue side (the short-wave region), but only very slight sensitivity on the red side (the long-wave region).

The result is that an electrophotograph displays a red character in the same way as a black character. Under certain circumstances, particularly when the master is in color, this result may be a drawback in practical use. For example, a black character on a red background (or vice versa) cannot be distinguished from its background and, therefore, cannot be identified.

It is known that crystallized selenium, as opposed to amorphous selenium, is extremely red sensitive, or "high dark conductive". Therefore, when crystallized selenium is used, that part of the visible spectrum above 650 nm can also be utilized. However, the high dark conductivity of crystallized selenium, i.e., its property of conducting electrical current already in the unilluminated state to such a degree that an electrical charge applied to its surface cannot be held for the length of time required for electrophotographic purposes, also weighs against its use in electrophotography.

A photoconductive layer material which is red and blue sensitive, and is simultaneously distinguished by low dark conductivity, exists in a combination of amorphous and crystallized selenium. The combination of these two forms of selenium may have a layer structure where, for example, crystallized selenium is initially applied to a conductive substrate upon which a layer of amorphous selenium is then applied.

However, the manufacture of such a dual photoconductive layer is very difficult because in order to assure perfect operation, i.e., particularly to provide uniform red sensitivity over the entire area of the photoconductive layer, it is necessary for the lower partial layer to be crystallized to cover the entire surface area with a completely uniform and sufficient thickness.

However, such uniformity is difficult or impossible to attain during or after the vapor-deposition process under the influence of the higher temperatures required to produce crystallization pursuant to the conventional thermal treatment of a vapor-deposited amorphous layer. This is due to the minimum required temperature of about 70° C. to produce crystallization and the competing requirement that the temperature be kept as low as possible to attain the greatest possible uniformity during crystallization. For these reasons, a very narrow constant temperature range must be set during vapor-deposition which involves considerable expenditures, particularly for the manufacture of larger quantities, and especially since this temperature regulation must take place in a vacuum.

Moreover, crystallization depends to a great degree on other crystal nuclei, such as surface inhomogeneities, which may happen to be present on the substrate surface. Spontaneous crystallization resulting from these nuclei is almost impossible to control, especially since the crystallization depends on the variables of the individual substrate. With such irregular crystal nuclei formation, the further development of the crystallization cannot be performed reliably with the required uniformity.

However, if temperatures are increased to assure with greater certainty the complete crystallization of the lower partial layer, there exists the danger that the upper partial layer, which must retain its amorphous state in order to maintain its low dark discharging capability, will also convert (more or less, and irregularly) to the crystallized state—which is just as undesirable.

A publication by Kohei Kiyota and Kunihiko Tasai, entitled "Selenium Element for Photoelectrostatography", published in the Fujitsu Scientific and Technical Journal (December, 1975), discloses that a photoconductive dual layer of crystallized and amorphous selenium can be produced by vapor-deposition of selenium onto a layer of manganese which acts as a crystallization nucleus for the selenium. The conversion of the initially amorphous selenium to the crystallized form disclosed in this publication is effected by subsequent tempering at about 80° C. to keep the conversion rate high enough so that the conversion time is sufficiently short. The drawback in selecting such a high conversion temperature is the previously-described danger that the upper amorphous partial layer will then also convert to the crystallized state. Therefore, the process disclosed in this publication also requires the maintenance of a very narrowly defined temperature range. Moreover, the additional process step of tempering after the vapor-deposition step is still necessary.

German Auslegeschrift No. 2,808,757 (Application published after examination) (which corresponds to our pending Application Ser. No. 012,858) discloses a process in which a dual layer of amorphous and crystallized selenium is produced on a conductive substrate after tellurium is applied to the conductive substrate to a layer thickness of 10 to 500 nanometers. The electrophotographic recording material produced in this way is distinguished by improved spectral sensitivity.

SUMMARY OF THE INVENTION

It is an object of the present invention to provide a process for producing an electrophotographic recording material which includes an electrically conductive substrate and a dual photoconductive layer of crystallized and amorphous selenium applied to the substrate. In this manner, the recording material so produced will be photosensitive in the blue-green as well as in the red spectral range. In particular, the recording material produced according to the present invention exhibits even greater and improved red sensitivity than the materials produced according to the prior art methods. Moreover, the recording material is distinguished by uniform photosensitivity over its entire photoconductive surface and is to be independent of the contingencies of spontaneous crystallization. The required uniformity of characteristics is achieved by a relatively simple manufacturing process.

These and other objects are accomplished by the present invention which includes a method for producing an electrophotographic recording material of a dual layer of amorphous and crystallized selenium that is applied to an electrically conductive substrate which has been vapor-deposited with a layer of tellurium. The vapor-deposition of the tellurium to the substrate is performed in a vacuum to a layer thickness of about 0.5 to about 5 nanometers, after the substrate has been first prepared in a known manner and has been appropriately preheated, if required. The selenium is then vapor-deposited onto the tellurium layer to form a further layer having a thickness of about 20 to about 100 microns. Preferably, the tellurium is vapor-deposited to a layer thickness of 1 nanometer.

The method according to the present invention further accomplishes the production of a uniform layer of crystallization nuclei on the surface of the conductive substrate such that the formation of these nuclei does not depend on random occurrences. The tellurium is vapor-deposited in fine crystalline form without the need for any additional thermal treatment. The fine tellurium crystals act as crystallization nuclei for the selenium layer deposited thereonto. Thus, with the layer thickness proposed by the present invention, a uniform uninterrupted cover of crystallization nuclei is formed, which results in a very uniform crystalline growth of the subsequently vapor-deposited selenium layer.

Surprisingly, under the conditions provided by the present invention, the intended crystalline selenium layer forms during the vapor-deposition process. The crystalline selenium layer exhibits a thickness of about 0.3 to about 3 microns and is distinguished by a well-defined transition from the crystalline to the amorphous layer. Thus, an additional tempering step after the vapor-deposition is no longer necessary.

It has further been surprisingly found under the conditions provided by the present invention that a particularly thin tellurium layer on the conductive substrate, which requires little and economically feasible amounts of material, sufficiently serves as a crystallization nucleus for the uniform selenium crystallization. In addition, the thinness of the tellurium layer provides a particular advantage in that the residual radiation not absorbed by the selenium layers will also not be completely or predominantly absorbed by the tellurium layer. Rather, a significant portion of this residual radiation can penetrate the relatively thin tellurium layer, can be reflected at the surface of the conductive substrate and, after being able to repenetrate the tellurium layer, can impinge a second time on the crystallized red-sensitive selenium layer. This results in a considerable increase in the red sensitivity of the layers of the electrophotographic recording material. For the wavelength range of about 650 to about 750 nanometers, the increase in sensitivity is more than 1.5 times that of conventional layer sequences.

The process according to the present invention therefore offers a possibility of producing a dual layer of crystallized and amorphous selenium in one simple process step with uniform formation of the individual layers. The recording material thus produced also exhibits the required uniform sensitivity over a wide spectral range and results in photocopies of high quality.

It is preferable to maintain the pressure below $10^{-4}$ millibars during the tellurium vapor-deposition on the conductive substrate, which may be an aluminum disc or aluminum drum. Uniform coating of the tellurium onto the substrate in the intended layer thickness is realized in an advantageous manner by vapor-depositing the tellurium from a heated molybdenum band onto which it has been previously applied in corresponding quantities. The vapor-deposition can also be effected from an open boat-like crucible which serves as the evaporation source. The length of the boat corresponds to the length of the conductive substrate. The vapor-deposition rate should be about 3 nanometer layer thickness/minute so that for the preferred 1 nanometer layer thickness of the tellurium is attained in approximately 20 seconds.

In order to avoid variations in the thickness of the tellurium layer applied to the substrate (which may result from directed vapor streams), the surfaces of the evaporating tellurium and of the substrate to be coated should not be oriented towards one another. Instead the surfaces should be oriented to conduct the streams of vapor developing during the evaporation process either at a right angle to the surface of the substrate or in a direction opposite to the surface of the substrate. The tellurium is then deposited onto the surface of the substrate from a diffuse distribution in an evaporation chamber by diffusion or under the effect of gravity.

DESCRIPTION OF THE PREFERRED EMBODIMENTS

Figure 1:
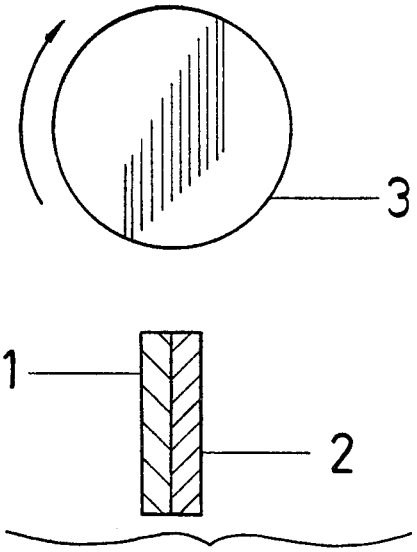
FIGS. 1 and 2 show alternative schematic arrangements for applying a layer of tellurium to a conductive substrate.
Figure 2:
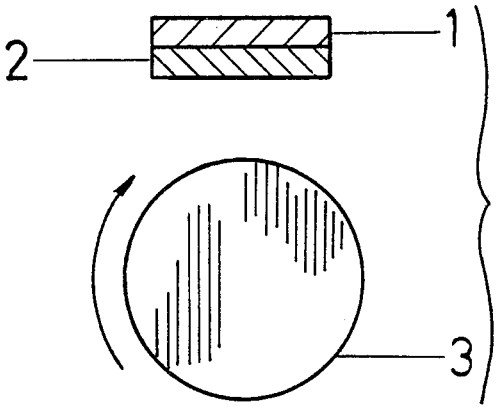

As shown in FIG. 1, tellurium 1 is vapor-deposited from a molybdenum band 2 onto a rotating drum-shaped conductive substrate 3. In this case, the surface of the evaporating tellurium is oriented substantially perpendicularly to the surface position of the drum 3 closest to the tellurium source. FIG. 2 shows in a corresponding manner that the surface of the evaporating tellurium 1 may face away from the surface of the drum 3.

If the tellurium is vapor-deposited onto the conductive substrate at temperatures between about 20° and about 30° C., it is advantageous to accelerate the heating of the substrate for the subsequent selenium vapor-deposition. This is done by ventilating the vacuum chamber temporarily before the selenium vapor-deposition takes place and by heating the substrate during that time to a temperature of about 62° to about 75° C. In this manner, the selenium can be vapor-deposited from an open boat-like crucible in approximately the same vacuum as during the tellurium vapor-deposition, and at a rate of about 1 micron/minute, to reach the preferred layer thickness in 60 minutes. In view of the relatively high substrate temperature utilized during the selenium vapor-deposition, it is also possible to initially set the substrate temperature at about 60° C. for the tellurium vapor-deposition as well, so that intermediate ventilation and heating can be omitted.

The process according to the present invention will be explained once more in connection with a preferred embodiment.

An electrically conductive substrate in the form of a planar plate or a cylindrical drum 3, preferably of aluminum, is introduced into a vacuum chamber (not shown) after its surface has been treated initially in a manner customary for electrophotographic processes, for example, as disclosed in U.S. Pat. No. 2,753,278. This surface treating of the conductive substrate is performed after its temperature has been increased by heating between about 62° and about 75° C., for example, with the aid of a heated rotary shaft. When the pressure in the vacuum chamber drops below $10^{-4}$ millibar, tellurium 1 is vapor-deposited from molybdenum band 2 which has been coated uniformly with such a quantity of tellurium that the intended layer thickness can be formed on the conductive substrate. Band 2 is in the form of a resistance heater to effect the vapor-deposition. In order to achieve as uniform an evaporation as possible from the molybdenum band 2, and as uniform a coating of the conductive substrate 3 as possible, the length of the molybdenum band 2 should correspond at least to the length of the substrate 3, or even somewhat exceed it. The vapor-deposition rate for the tellurium is selected so that a layer thickness of 1 nanometer is attained in about 20 seconds.

Once the tellurium 1 has been completely evaporated from the molybdenum band 2 and the heating current of the band has been turned off, selenium is vapor-deposited from an open evaporation boat-like crucible (not shown) while maintaining the vacuum and the substrate temperature. For the above-described reasons of uniform distribution, the length of the evaporation boat is adapted to the length of the conductive substrate 3. The selenium vapor-deposition rate should be about 1 micron/minute so that the intended layer thickness of 60 microns is reached after about 60 minutes.

It is advantageous to initially vapor-deposit the selenium onto the tellurium layer of the substrate to a layer thickness of about 1 to about 3 microns. The substrate should be heated to between about 68° and about 75° C., and the deposition rate should be about 0.05 to about 0.5 micron/minute. At this point, the substrate temperature is lowered to between about 60° and about 65° C., and thereafter the remaining selenium is vapor-deposited at a rate of about 0.5 to about 5 microns/minute. Alternatively, the selenium could be vapor-deposited from a first evaporator (not shown) to a layer thickness of about 1 to about 3 microns, and the remaining selenium layer vapor-deposited from a second evaporator (not shown).

After cooling the evaporator and ventilating the vacuum chamber, the coated substrates can be removed. The dual photoconductive layer resulting from the method of the present invention as discussed immediately above comprises a layer of crystallized selenium at a thickness of about 0.3 to about 3 microns, with amorphous selenium above the crystallized layer.

The layer of crystallized selenium is distinguished by particular uniformity as evidenced from electron microscope photographs. Therefore, the resultant recording material permits reproductions over a broad spectral sensitivity range at a uniformity which is considerably improved over that attained with prior art methods.

It is to be understood that the above description of the present invention is susceptible to various modifications, changes and adaptations, and the same are intended to be comprehended within the meaning and range of equivalents of the appended claims.

What is claimed is:

1. In a method for producing an electrophotographic recording material composed of a dual layer of amorphous and crystallized selenium applied to an electrically conductive substrate, the improvement comprising the steps of:

vapor-depositing tellurium in a vacuum onto the surface of the conductive substrate to a layer thickness of about 0.5 to about 5 nanometers to form a tellurium layer; and vapor-depositing selenium onto said tellurium layer to a layer thickness of about 20 to about 100 microns to form the dual layer of amorphous and crystallized selenium.

2. The method as defined in claim 1, further comprising the step of:

preheating the conductive substrate prior to said step of vapor-depositing tellurium.

3. The method as defined in claims 1 or 2, wherein the tellurium is vapor-deposited to a layer thickness of 1 nanometer.

4. The method as defined in claims 1 or 2, wherein said steps of vapor-depositing are performed at a pressure of less than $10^{-4}$ millibars.

5. The method as defined in claims 1 or 2, wherein said step of vapor-depositing tellurium is performed at the rate of 3 nanometers/minute.

6. The method as defined in claims 1 or 2, wherein said step of vapor-depositing selenium is performed at the rate of 1 micron/minute.

7. The method as defined in claims 1 or 2, further comprising the step of preheating the conductive substrate to a temperature of about 62° to about 75° C. prior to said step of vapor-depositing tellurium and wherein said steps of vapor-depositing are performed in a single operation.

8. The method as defined in claim 1, wherein said step of vapor-depositing tellurium is carried out at a temperature of about 20° to about 30° C., further comprising preheating the conductive substrate to a temperature of about 62° to about 75° C. after said step of vapor-depositing tellurium and before said step of vapor-depositing selenium, and wherein said step of vapor-depositing selenium is carried out at the temperature to which the substrate has been preheated.

9. The method as defined in claim 1 wherein said step of vapor-depositing selenium comprises, after said step of vapor-depositing tellurium:

preheating the substrate to a temperature of about 60° to about 75° C.;

vapor-depositing selenium onto the preheated substrate at a rate of about 0.05 to 0.5 micron/minute to a thickness of about 1 to about 3 microns;

lowering the substrate temperature to between about 60° and about 65° C.; and additionally vapor-depositing selenium, with the substrate at the lowered temperature, at a rate of about 0.5 to about 5 microns/minute to the desired dual layer thickness.

10. The method as defined in claims 1 or 2, wherein said step of vapor-depositing selenium is performed in two stages, the first stage being performed by evaporating selenium from a first evaporator to a layer thickness of about 1 to about 3 microns, and the second stage being performed by evaporating selenium from a second evaporator to achieve the dual layer thickness of about 20 to about 100 microns.

11. A method as defined in claims 1 or 2, wherein said step of vapor-depositing tellurium is performed by evaporating tellurium from a surface which is so oriented relative to the substrate for causing streams of tellurium vapor to be emitted from the surface in a direction away from the substrate.

12. The method as defined in claim 11 wherein the surface is oriented for causing the streams of vapor to be emitted in a direction approximately perpendicular to the general direction from the surface to the substrate.

13. The method as defined in claim 11 wherein the surface is oriented for causing the streams of vapor to be emitted in a direction approximately opposite to the general direction from the surface to the substrate.

* * * * *